US005799802A

United States Patent [19]

Delia et al.

[11] Patent Number: 5,799,802

[45] Date of Patent: Sep. 1, 1998

[54] STEMMED GLASSWARE SEPARATORS

[76] Inventors: Carl F. Delia; Barbara A. Delia, both of 23041 Posada Dr., Valencia, Calif. 91354

[21] Appl. No.: 769,754

[22] Filed: Dec. 20, 1996

[51] Int. Cl.[6] ..... A47F 5/00

[52] U.S. Cl. ..... 211/184; 211/41.2; 206/814

[58] Field of Search ..... 211/184, 94.01, 211/94.02, 94.03, 162, 71, 41.2; D7/701, 704; 312/132, 128, 334.23; D6/553, 513; 206/814, 821, 500

[56] References Cited

U.S. PATENT DOCUMENTS

| | | | |
|---|---|---|---|
| D. 273,446 | 4/1984 | Rankin et al. | D7/701 X |
| 2,288,071 | 6/1942 | Cohen | 211/184 X |
| 2,750,028 | 6/1956 | Bode et al. | 206/821 X |
| 3,022,899 | 2/1962 | Unsworth | 211/41.2 |
| 4,228,905 | 10/1980 | Cammarota | 211/41.2 |
| 5,209,357 | 5/1993 | Cannon | 211/184 X |
| 5,370,064 | 12/1994 | Sgabellone | 108/162 |

FOREIGN PATENT DOCUMENTS

| | | | |
|---|---|---|---|
| 1375088 | 9/1964 | France | 206/500 |

*Primary Examiner*—Peter M. Cuomo
*Assistant Examiner*—Janet M. Wilkins

[57] ABSTRACT

Stemmed glassware separators including a plurality of separators. Each of the separators have a T-shaped upper portion and an arcuate lower portion. Each of the separators are slidably disposed within a hanging wine rack between two wine glasses hanging therefrom.

5 Claims, 3 Drawing Sheets

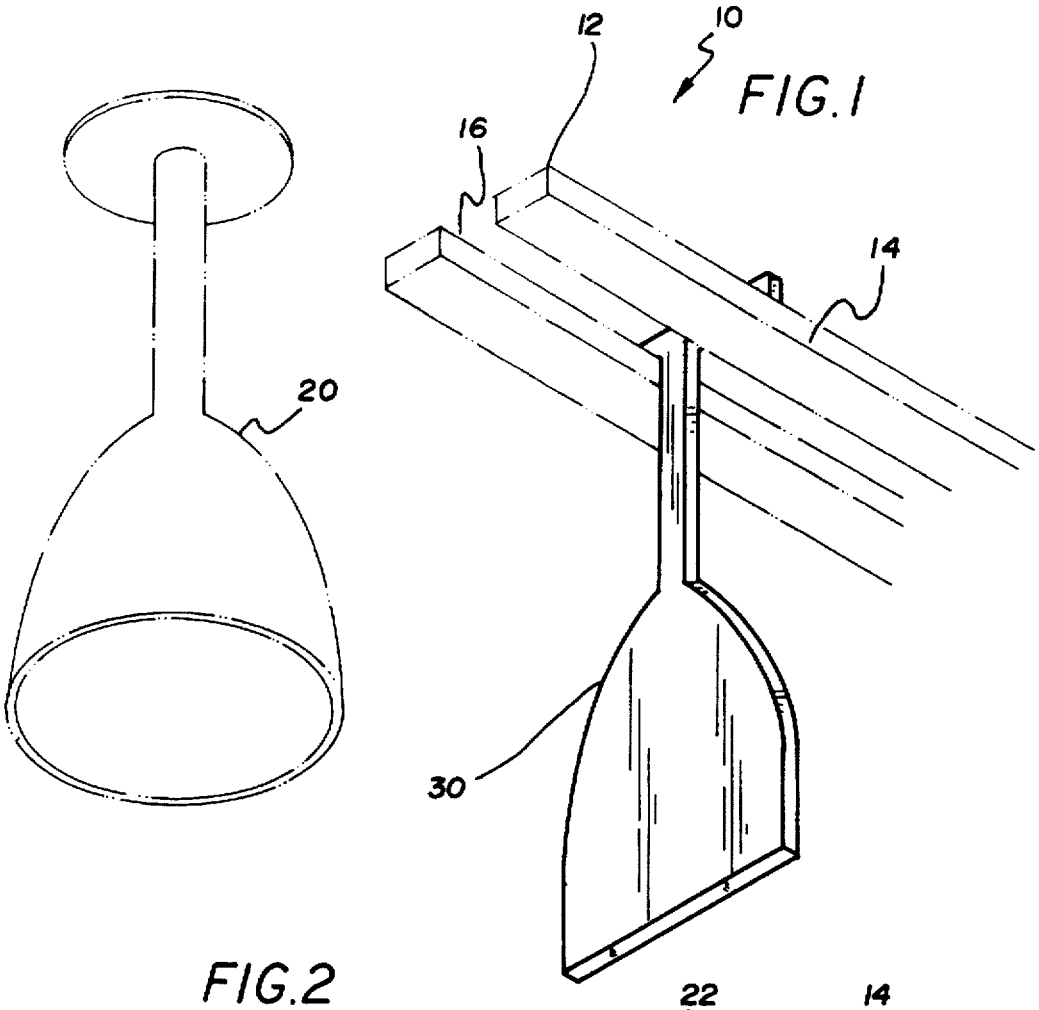
FIG.1
FIG.2
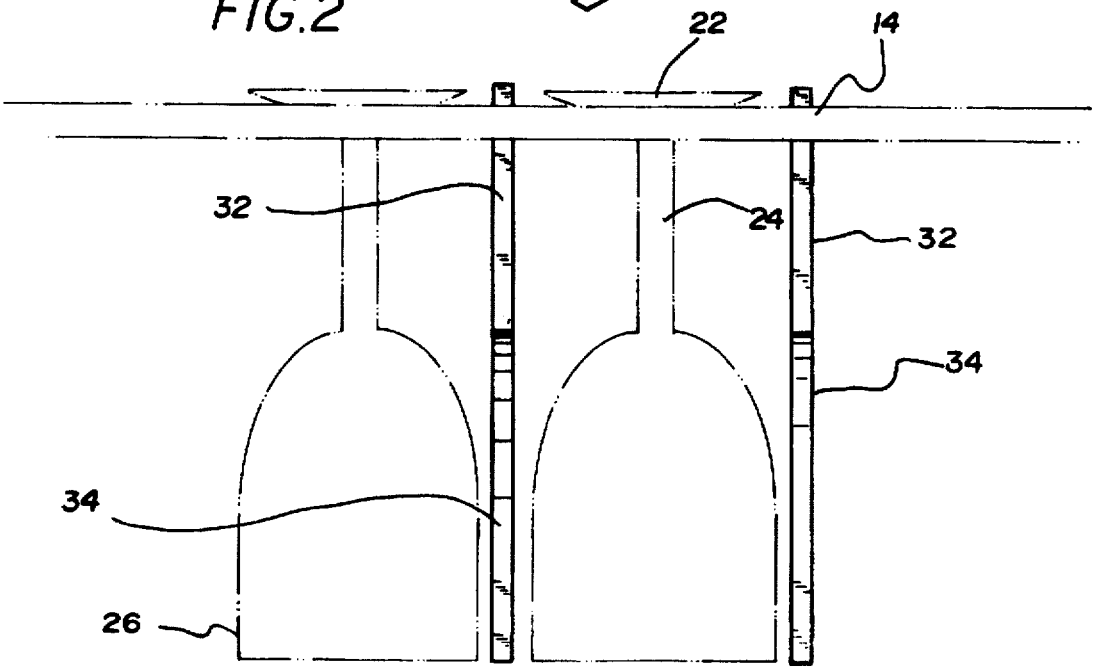

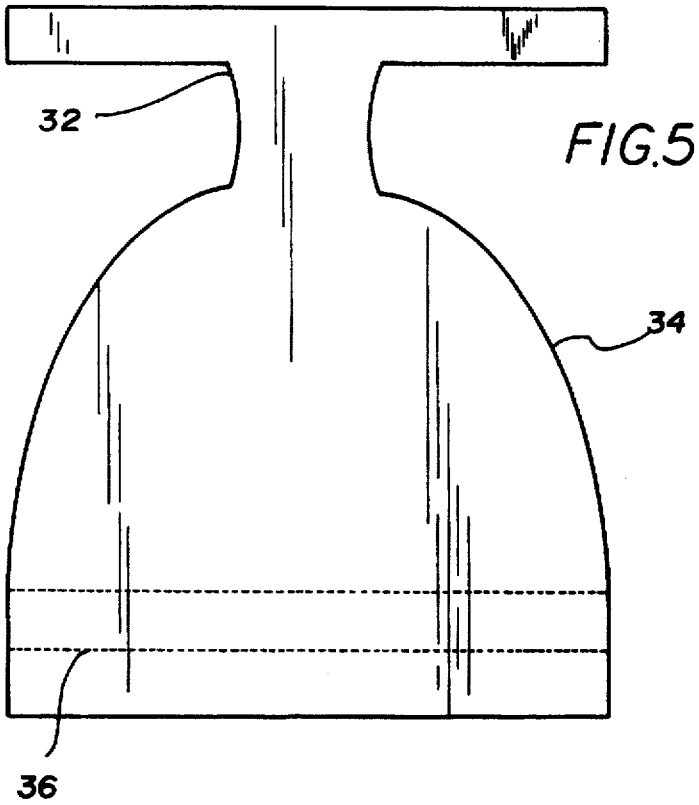
FIG.5
FIG.6
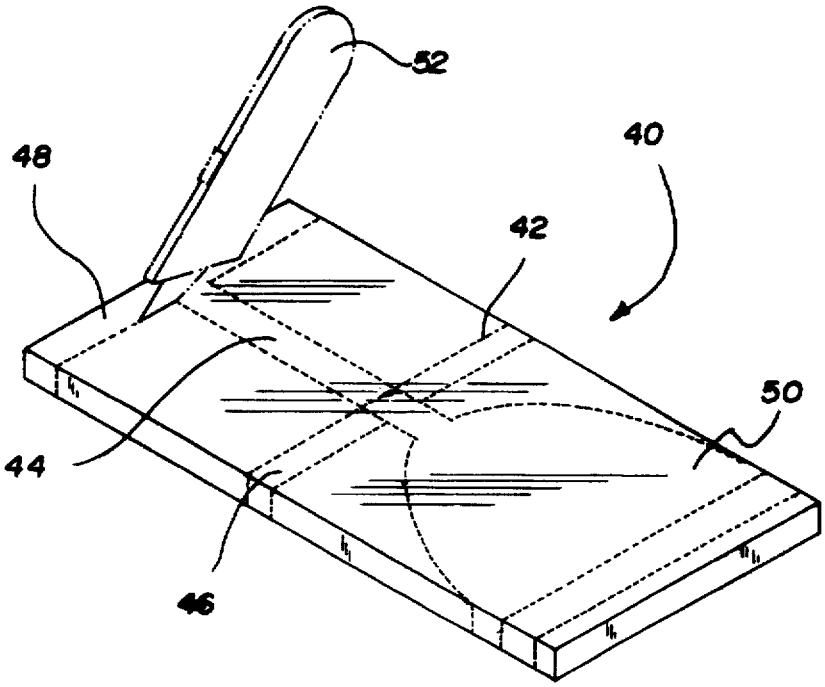

STEMMED GLASSWARE SEPARATORS

BACKGROUND OF THE INVENTION

1. Field of the Invention

The present invention relates to stemmed glassware separators and more particularly pertains to separating and protecting stemware while hanging from a rack with stemmed glassware separators.

2. Description of the Prior Art

The use of containers is known in the prior art. More specifically, containers heretofore devised and utilized for the purpose of packing and segregating articles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,640,417 to Durand discloses a display-packing unit for glasses and similar articles.

U.S. Pat. No. 4,057,950 to Focke discloses a cardboard container for bottles and the like.

U.S. Pat. No. Des. 299,993 to Durand discloses the ornamental design for a stemmed wine glass or similar article.

U.S. Pat. No. 4,231,510 to Beard discloses a light bulb container.

U.S. Pat. No. 4,993,770 to Groves discloses a carrying device for athletic weights.

U.S. Pat. No. 5,326,019 to Wolff discloses a double walled paper cup.

While these devices fulfill their respective, particular objective and requirements, the aforementioned patents do not describe stemmed glassware separators for separating and protecting stemware while hanging from a rack.

In this respect, the stemmed glassware separators according to the present invention substantially departs from the conventional concepts and designs of the prior art, and in doing so provides an apparatus primarily developed for the purpose of separating and protecting stemware while hanging from a rack.

Therefore, it can be appreciated that there exists a continuing need for new and improved stemmed glassware separators which can be used for separating and protecting stemware while hanging from a rack. In this regard, the present invention substantially fulfills this need.

SUMMARY OF THE INVENTION

In the view of the foregoing disadvantages inherent in the known types of containers now present in the prior art, the present invention provides improved stemmed glassware separators. As such, the general purpose of the present invention, which will be described subsequently in greater detail, is to provide new and improved stemmed glassware separators and method which has all the advantages of the prior art and none of the disadvantages.

To attain this, the present invention essentially comprises a wine rack comprised of a pair of elongated and planar rods. The pair of rods have a space disposed therebetween. The device includes a plurality of wine glasses of a predetermined length. Each of the wine glasses have a base portion, a stem portion, and a liquid containing portion. Each of the wine glasses are slidably disposed within the wine rack in an inverted orientation with the stem portion in the space disposed between the pair of rods and the base portion disposed above the pair of rods. The device includes a plurality of separators of a predetermined length corresponding to the length of the plurality of wine glasses. Each of the separators have a T-shaped upper portion and an arcuate lower portion. Each of the separators are slidably disposed within the wine rack between two of the plurality of wine glasses.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved stemmed glassware separators which has all the advantages of the prior art containers and none of the disadvantages.

It is another object of the present invention to provide new and improved stemmed glassware separators which may be easily and efficiently manufactured and marketed.

It is a further object of the present invention to provide new and improved stemmed glassware separators which is of durable and reliable construction.

An even further object of the present invention is to provide new and improved stemmed glassware separators which is susceptible of a low cost of manufacture with regard to both materials and labor, and which accordingly is then susceptible of low prices of sale to the consuming public, thereby making such a stemmed glassware separators economically available to the buying public.

Even still another object of the present invention is to provide new and improved stemmed glassware separators for separating and protecting stemware while hanging from a rack.

Lastly, it is an object of the present invention to provide new and improved stemmed glassware separators including a plurality of separators. Each of the separators have a T-shaped upper portion and an arcuate lower portion. Each of the separators are slidably disposed within a hanging wine rack between two wine glasses hanging therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the stemmed glassware separators constructed in accordance with the principles of the present invention.

FIG. 2 is a side elevation view of the present invention shown in use.

FIG. 5 is a front elevation view of a third embodiment of the present invention.

FIG. 6 is a perspective view of a fourth embodiment of the present invention.

The same reference numerals refer to the same parts through the various Figures.

DESCRIPTION OF THE PREFERRED EMBODIMENT

Figure 3:
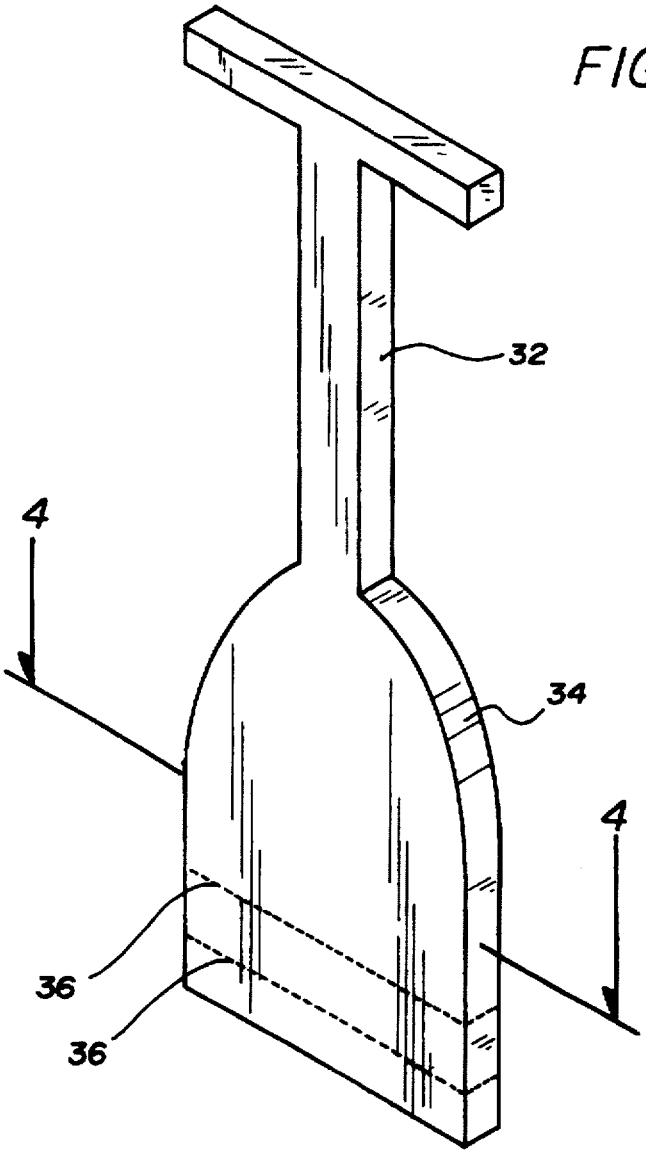
FIG. 3 is a perspective view of a second embodiment of the present invention.

With reference now to the drawings, and in particular, to FIGS. 1 through 6 thereof, the preferred embodiment of the new and improved stemmed glassware separators embodying the principles and concepts of the present invention and generally designated by the reference number 10 will be described.

Specifically, it will be noted in the various Figures that the device relates to stemmed glassware separators for separating and protecting stemware while hanging from a rack. In its broadest context, the device consists of a wine rack, a plurality of wine glasses and a plurality of separators. Such components are individually configured and correlated with respect to each other so as to attain the desired objective.

The device 10 includes a wine rack 12 comprised of a pair of elongated and planar rods 14. The pair of rods 14 have a space 16 disposed therebetween.

The device 10 includes a plurality of wine glasses 20 of a predetermined length. Each of the wine glasses 20 have a base portion 22, a stem portion 24, and a liquid containing portion 26. Each of the wine glasses 20 are slidably disposed within the wine rack 12 in an inverted orientation with the stem portion 24 in the space 16 disposed between the pair of rods 14 and the base portion 22 disposed above the pair of rods 16.

Next, the device 10 includes a plurality of separators 30 of a predetermined length corresponding to the length of the plurality of wine glasses 20. Each of the separators 30 have a T-shaped upper portion 32 and an arcuate lower portion 34. Each of the separators 30 are slidably disposed within the wine rack 12 between two of the plurality of wine glasses 20.

Figure 4:
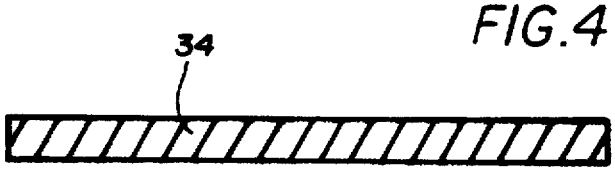
FIG. 4 is a cross-sectional view as taken along line 4—4 of FIG. 3.

A second embodiment of the present invention is shown in FIGS. 3 and 4 and includes substantially all of the components of the present invention wherein the arcuate lower portion 34 of the separators 30 have a plurality of perforated lines 36 extending thereacross for adjusting a length of the separators 30 to correspond to a length of the wine glasses 20 to be separated.

A third embodiment of the present invention is shown in FIG. 5 and includes substantially all of the components of the present invention wherein the T-shaped upper portion 32 of the separators 30 is of a reduced length and the arcuate lower portion 34 have a plurality the perforated lines 36 extending thereacross for adjusting a length of the separators 30 to correspond to a length of the wine glasses to be separated.

A fourth embodiment of the present invention is shown in FIG. 6 and includes substantially all of the components of the present invention and further including a rectangular and planar member 40 having perforations 42 formed therein. The perforations 42 form a shape of a wine glass. The perforations 42 form a central stem portion 44, an upper and lower base member 46,48 and a height adjustable arcuate base portion 50. A utility knife 52 is provided for cutting along the perforations 42 of the rectangular and planar member 40 to a desired size corresponding to selected stemmed glassware.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A system for separating and protecting stemware while hanging from a rack comprising, in combination:

a wine rack comprised of a pair of elongated and planar rods, the pair of rods having a space disposed therebetween;

a plurality of wine glasses of a predetermined length, each of the wine glasses having a base portion, a stem portion, and a liquid containing portion, each of the wine glasses slidably disposed within the wine rack in an inverted orientation with the stem portion in the space disposed between the pair of rods and the base portion disposed above the pair of rods;

a plurality of separators of a predetermined length corresponding to the length of each of the plurality of wine glasses, each of the separators having a T-shaped upper portion and an arcuate lower portion, each of the separators slidably disposed within the wine rack between two of the plurality of wine glasses.

2. A system comprising, in combination:

a plurality of separators, each of the separators having a T-shaped upper portion and an arcuate lower portion, each of the separators slidably disposed within a hanging wine rack between two wine glasses hanging therefrom.

3. The system as set forth in claim 2 wherein the arcuate lower portion of the separators have a plurality of perforated lines extending thereacross for adjusting a length of the separators to correspond to a length of the wine glasses to be separated.

4. A system of glassware separators each comprising:

a rectangular and planar member having perforations formed therein, the perforations forming a shape of a wine glass;

wherein the perforations forming a central stem portion, an upper and lower base member and a height adjustable arcuate lower portion.

5. The system as set forth in claim 4 and further including a utility knife for cutting along the perforations of the rectangular and planar member to a desired size corresponding to selected stemmed glassware.

* * * * *